US005570574A

United States Patent [19]

Yamashita et al.

[11] Patent Number: 5,570,574

[45] Date of Patent: Nov. 5, 1996

[54] AIR-FUEL RATIO CONTROL SYSTEM FOR INTERNAL COMBUSTION ENGINE

[75] Inventors: Yukihiro Yamashita, Kariya; Toshihiro Suzumura, Nagoya, both of Japan

[73] Assignee: Nippondenso Co., Ltd., Aichi-Pref., Japan

[21] Appl. No.: 352,208

[22] Filed: Dec. 2, 1994

[30] Foreign Application Priority Data

Dec. 3, 1993 [JP] Japan ..... 5-304434

[51] Int. Cl.[6] ..... F01N 3/28

[52] U.S. Cl. ..... 60/276; 60/285; 123/692

[58] Field of Search ..... 60/274, 276, 285; 123/692

[56] References Cited

U.S. PATENT DOCUMENTS

| | | | |
|---|---|---|---|
| 5,207,057 | 5/1993 | Kayanuma | 60/285 |
| 5,233,829 | 8/1993 | Komatsu | 123/692 |
| 5,390,650 | 2/1995 | Gee | 123/692 |

FOREIGN PATENT DOCUMENTS

| | | |
|---|---|---|
| 64-8332 | 1/1989 | Japan . |
| 3-38417 | 6/1991 | Japan . |
| 6-50192 | 2/1994 | Japan . |

*Primary Examiner*—Douglas Hart

*Attorney, Agent, or Firm*—Cushman Darby & Cushman, LLP

[57] ABSTRACT

An air-fuel ratio control system for an internal combustion engine includes a pair of cylinder banks, a pair of exhaust passages connected to the cylinder banks, respectively, a common exhaust pipe where the exhaust passages join each other at their downstream ends, a pair of catalytic converters provided in the exhaust passages, respectively, a pair of main air-fuel ratio sensors provided in the exhaust passages upstream of the catalytic converters, respectively, a pair of auxiliary air-fuel ratio sensors provided in the exhaust passages downstream of the catalytic converters, respectively, and a catalytic converter provided in the common exhaust pipe. The system derives an air-fuel ratio feedback control correction value for each of the cylinder banks based on outputs of the auxiliary air-fuel ratio sensors. The system derives the air-fuel ratio feedback control correction values in such a manner as to control the outputs of the auxiliary air-fuel ratio sensors to be in antiphase with each other when the outputs of the auxiliary air-fuel ratio sensors are in phase with each other. This arrangement ensures effective purification of exhaust gases at the catalytic converter provided in the common exhaust pipe.

10 Claims, 7 Drawing Sheets

AIR-FUEL RATIO CONTROL SYSTEM FOR INTERNAL COMBUSTION ENGINE

BACKGROUND OF THE INVENTION

1. Field of the Invention

The present invention relates to an air-fuel ratio control system for an internal combustion engine, wherein an air-fuel ratio of an air-fuel mixture is feedback controlled to a given value based on a signal from an exhaust gas sensor which monitors a concentration of a certain component contained in the exhaust gas discharged from engine cylinders. The present invention particularly relates to the air-fuel ratio control system for such an engine as a V-type engine, which has an exhaust system divided into two lines for respective cylinder banks.

2. Description of the Prior Art

The air-fuel ratio control system for the V-type engine is known, as disclosed, such as, in Japanese Second (examined) Patent Publication No. 3-38417. The V-type engine has two cylinder banks and two exhaust passages connected to the respective cylinder banks. The air-fuel ratio control is performed by controlling air-fuel ratios of air-fuel mixtures for the respective cylinder banks, that is, output values of air-fuel ratio sensors for the respective cylinder banks, to be in antiphase or opposite phase with each other, that is, symmetrical with respect to a reference value. This symmetrical control of the air-fuel ratios is performed for purpose of preventing the torque fluctuation of the engine and the lowering of purification factors of catalytic converters provided in the respective exhaust passages.

On the other hand, following the tightening of automotive emission regulation, the so-called two-sensor system has been recently available, wherein air-fuel ratio sensors are provided both upstream and downstream of a catalytic converter. In this system, a deviation or an offset of a controlled air-fuel ratio relative to a window of the catalytic converter is detected based on an output of the air-fuel ratio sensor downstream of the catalytic converter for finely adjusting the controlled air-fuel ratio so as to eliminate such a deviation.

In the former conventional air-fuel ratio control system which performs the antiphase control of the outputs of the respective air-fuel ratio sensors, it is unknown how exhaust gases discharged from the respective cylinder banks are actually purified by the catalytic converters. On the other hand, in the latter conventional air-fuel ratio control system of the two-sensor type, due to a large transfer delay of the exhaust gas caused by the catalytic converter, an air-fuel ratio as monitored based on the exhaust gas downstream of the catalytic converter can not be controlled to the stoichiometric value ($\lambda=1$), leading to large alternate deviations to lean and rich sides with respect to the stoichiometric value ($\lambda=1$). This results in alternate emissions of harmful components, that is, NOx on the lean side and HC and CO on the rich side, to the atmosphere via a tail pipe.

For further purification of the exhaust gas, a catalytic converter may be further provided in a common exhaust pipe where the exhaust passages from the respective cylinder banks join each other at their downstream ends. However, in case of the V-type engine, when the exhaust gases discharged from the respective cylinder banks are in phase with each other in terms of air-fuel ratio, the harmful components are likely to be discharged via the tail pipe as exceeding the purification capability of the catalytic converter provided in the common exhaust pipe.

On the other hand, when the exhaust gases in antiphase with each other in terms of air-fuel ratio are introduced through the respective exhaust passages, the catalytic converter in the common exhaust pipe is effectively supplied with the mutually reactive components contained in the antiphase exhaust gases so as to achieve the purification thereof to a sufficient level.

SUMMARY OF THE INVENTION

Therefore, it is an object of the present invention to provide an improved air-fuel ratio control system for an internal combustion engine, which allows a catalytic converter in a common exhaust pipe to achieve effective purification of exhaust gas.

According to one aspect of the present invention, an air-fuel ratio control system for an internal combustion engine comprises a pair of cylinder banks; a pair of exhaust passages connected to the cylinder banks, respectively; a common exhaust pipe where the exhaust passages join each other at their downstream ends; a pair of catalytic converters provided in the exhaust passages, respectively; a pair of main air-fuel ratio sensors provided in the exhaust passages upstream of the catalytic converters, respectively; a pair of auxiliary air-fuel ratio sensors provided in the exhaust passages downstream of the catalytic converters, respectively; a catalytic converter provided in the common exhaust pipe; deriving means for deriving an air-fuel ratio feedback control correction value for each of the cylinder banks based on outputs of the auxiliary air-fuel ratio sensors, the deriving means deriving the air-fuel ratio feedback control correction values so as to control the outputs of the auxiliary air-fuel ratio sensors to be in antiphase with each other when the outputs of the auxiliary air-fuel ratio sensors are in phase with each other; and feedback control means for feedback controlling an air-fuel ratio of an air-fuel mixture for each of the cylinder banks based on an output of the main air-fuel ratio sensor for the cylinder bank and the air-fuel ratio feedback control correction value for the cylinder bank.

According to another aspect of the present invention, an air-fuel ratio control system for an internal combustion engine comprises a pair of cylinder banks; a pair of exhaust passages connected to the cylinder banks, respectively; a common exhaust pipe where the exhaust passages join each other at their downstream ends; a pair of catalytic converters provided in the exhaust passages, respectively; a pair of main air-fuel ratio sensors provided in the exhaust passages upstream of the catalytic converters, respectively; a pair of auxiliary air-fuel ratio sensors provided in the exhaust passages downstream of the catalytic converters, respectively; a catalytic converter provided in the common exhaust pipe; deriving means for deriving first and second air-fuel ratio feedback control correction values for each of the cylinder banks based on outputs of the auxiliary air-fuel ratio sensors, the deriving means deriving the first and second air-fuel ratio feedback control correction values so as to control the outputs of the auxiliary air-fuel ratio sensors to be in antiphase with each other when the outputs of the auxiliary air-fuel ratio sensors are in phase with each other, the first air-fuel ratio control correction value for each of the cylinder banks to be used for controlling an air-fuel ratio of an air-fuel mixture for the corresponding cylinder bank to be leaner while the second air-fuel ratio control correction value for each of the cylinder banks is used for controlling the air-fuel ratio to be richer; and feedback control means for feedback controlling the air-fuel ratio of the air-fuel mixture for each of the cylinder banks based on an output of the main air-fuel ratio sensor for the cylinder bank and one of the first and second air-fuel ratio feedback control correction values for the cylinder bank.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENT

Now, a preferred embodiment of the present invention will be described hereinbelow with reference to the accompanying drawings.

Figure 1:
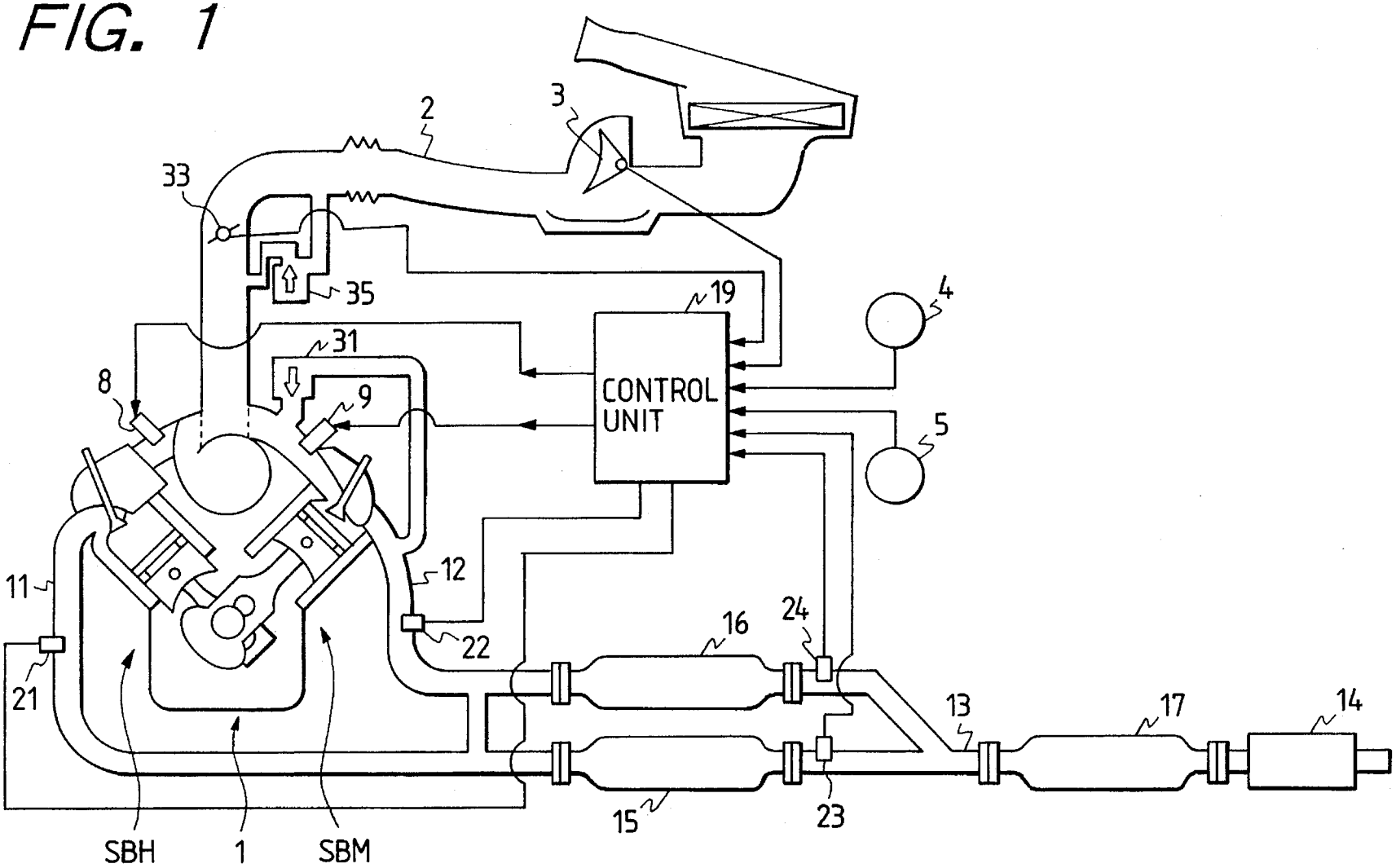
FIG. 1 is a diagram schematically showing the entire structure of a preferred embodiment of the present invention, wherein an air-fuel ratio control system is applied to a V-type six-cylinder gasoline engine.

FIG. 1 is a diagram schematically showing the entire structure of the preferred embodiment, wherein an air-fuel ratio control system is applied to a V-type six-cylinder gasoline engine.

In FIG. 1, the engine 1 has a pair of cylinder banks SBH and SBM arranged in a V-shape with a given bank angle therebetween. Each of the cylinder banks includes three of the six cylinders. In an intake passage 2 of the engine 1, an airflow meter 3 is disposed which directly measures an intake air amount introduced to the engine. The airflow meter 3 includes a potentiometer therein and produces a voltage signal in proportion to the intake air amount.

A coolant temperature sensor 4 is mounted to a water jacket (not shown) of a cylinder block of the engine 1 for monitoring an engine coolant temperature. The coolant temperature sensor 4 produces a voltage signal in proportion to the engine coolant temperature.

In a distributor 5, two rotation angle sensors are arranged which produce angular position signals per, for example, 360° CA (crank angle) and 30° CA, respectively. The angular position signals are used as, for example, an interrupt request signal in a fuel injection amount or time calculating routine, a reference ignition timing signal and an interrupt request signal in an ignition timing calculating routine.

In the intake passage 2, a fuel injection valve is further provided for each of the six cylinders for supplying a pressurized fuel to an intake port via a fuel supply system of the engine 1. In FIG. 1, numeral 8 represents one of the three cylinders in the cylinder bank SBH, and numeral 9 represents one of the three cylinders in the cylinder bank SBM.

An exhaust system of the engine 1 is divided into two lines for the cylinder banks SBH and SBM, respectively. Accordingly, a pair of exhaust passages 11 and 12 are provided, which are connected to downstream sides of the cylinder banks SBH and SBM, respectively, and join a common or collecting exhaust pipe 13 at their respective downstream ends. Three way catalytic converters 15 and 16 are provided in the exhaust passages 11 and 12, respectively. A three way catalytic converter 17 is further provided in the common exhaust pipe 13. These catalytic converters 15, 16 and 17 each work to simultaneously purify the harmful components HC, CO and NOx contained in the exhaust gas. Numeral 14 denotes a muffler.

Main air-fuel ratio sensors 21 and 22 are provided in the exhaust passages 11 and 12 upstream of the catalytic converters 15 and 16, respectively. Auxiliary air-fuel ratio sensors 23 and 24 are further provided in the exhaust passages 11 and 12 downstream of the catalytic converters 15 and 16, respectively. The air-fuel ratio sensors 21 to 24 each monitor an oxygen concentration in the exhaust gas passing therethrough and produce an output voltage which differs depending on whether an air-fuel ratio of the air-fuel mixture as monitored based on the exhaust gas is rich or lean with respect to the stoichiometric air-fuel ratio ($\lambda=1$).

Further, EGR (exhaust gas recirculation) control valve 31 is provided between the exhaust and induction systems of the engine 1 for controlling an EGR amount from the exhaust system to the induction system. An auxiliary valve 35 is further provided for controlling an amount of the intake air bypassing a throttle valve 33 so as to control an idling engine speed and the like.

A control unit 19 includes a microcomputer, a drive circuit and the like. The microcomputer includes, for example, a central processing unit (CPU), input/output (I/O) ports, a random access memory (RAM) and a read-only memory (ROM). The drive circuit amplifies an output of the microcomputer and produces a drive pulse signal for driving the fuel injection valves 8 and 9. The control unit 19 derives a basic fuel injection amount based on preselected engine operation parameters, such as, an engine speed NE monitored by the rotation angle sensor and an intake air amount Q monitored by the airflow meter 3. The control unit 19 further derives an actual fuel injection amount by correcting the basic fuel injection amount using, such as, an engine coolant temperature monitored by the coolant temperature sensor 4 and a concentration of a preselected component (an oxygen concentration in this preferred embodiment) in the exhaust gas monitored by the air-fuel ratio sensors 21 to 24. The control unit 19 controls an operation of the fuel injection valve 8, 9 depending on the derived actual fuel injection amount.

Now, an air-fuel ratio control of the air-fuel mixtures performed by the control unit 19 according to the preferred embodiment will be described hereinbelow.

Before describing in detail, outlines of the air-fuel ratio control according to the preferred embodiment will be given as compared with the conventional air-fuel ratio control.

In the conventional air-fuel ratio control, a PI (proportional and integral actions) control is performed based on an output signal from the air-fuel ratio sensor arranged upstream of the three way catalytic converter. An output signal from the air-fuel ratio sensor arranged downstream of the catalytic converter is used to, for example, make proportional components asymmetrical between the rich and lean sides, change a speed of the integral action, and change a comparison value for the air-fuel ratio sensor upstream of the catalytic converter, in an effort to finely adjust the center of the feedback control so as to match the air-fuel ratio with the window of the catalytic converter.

Since the exhaust gas is purified through the catalytic converter, the air-fuel ratio sensor downstream of the catalytic converter inevitably has a large response delay so that the lean components, such as, NOx and O2 and the rich components, such as, HC and CO are alternately discharged.

In this preferred embodiment, the catalytic converter 17 is further provided in the common exhaust pipe 13 of the V-type engine. When the components contained in the exhaust gases from the respective cylinder banks SBH and SBM are substantially the same, that is, when the exhaust gases from the respective cylinder banks are in phase with each other in terms of air-fuel ratio, the mutually reactive components at the catalytic converter 17 are so small in amount that the purification factor of the catalytic converter 17 can not be improved or enhanced.

On the other hand, when the components contained in the exhaust gases from the respective cylinder banks SBH and SBM are substantially in opposite relation, that is, when the exhaust gases from the respective cylinder banks are in antiphase with each other in terms of air-fuel ratio, the purification factor of the catalytic converter 17 can be improved due to a relatively large amount of the mutually reactive components.

Accordingly, in this preferred embodiment, the exhaust gases downstream of the respective catalytic converters 15 and 16 are monitored to control the air-fuel ratios of the air-fuel mixtures for the respective cylinder banks in such a manner as to prevent the exhaust gases downstream of the catalytic converters 15 and 16 from being in phase with each other in terms of air-fuel ratio. This provides the effective purification of the exhaust gas at the catalytic converter 17.

Hereinbelow, the air-fuel ratio control according to this preferred embodiment will be described in detail with reference to FIGS. 2 to 6.

Figure 2:
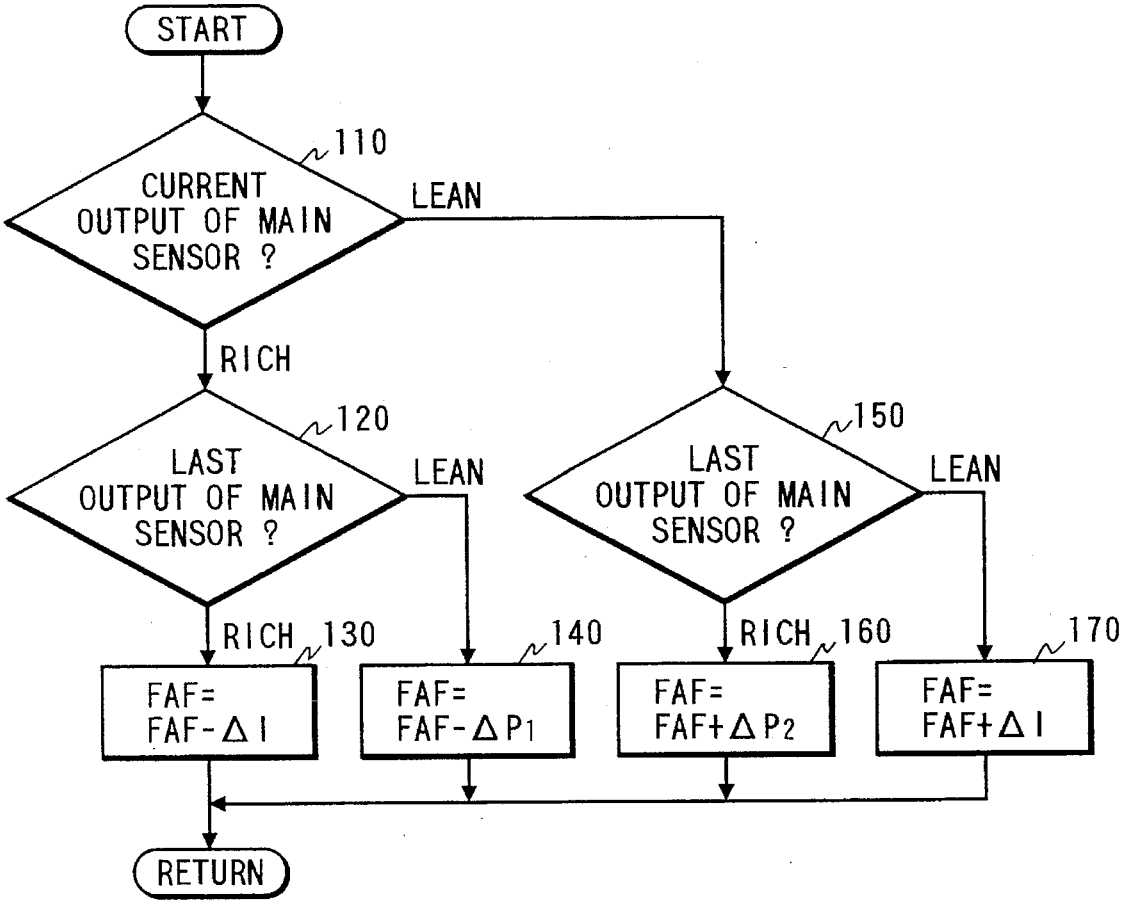
FIG. 2 is a flowchart showing a routine of a main feedback control to be executed by a control unit for deriving a feedback correction coefficient FAF.

FIG. 2 is a flowchart showing a routine of a main feedback control to be executed by the control unit 19 for deriving a feedback correction coefficient FAF. As is known, the feedback correction coefficient FAF is a correction value used for converging an air-fuel ratio of the air-fuel mixture to a target value, including the stoichiometric value ($\lambda=1$), in the feedback control. The FAF deriving routine is executed with respect to an output of each of the main air-fuel ratio sensors 21 and 22 provided upstream of the catalytic converters 15 and 16, and derives the feedback correction coefficient FAF for each of the cylinder banks SBH and SBM (hereinafter, the feedback correction coefficient FAF for the cylinder bank SBH will also be referred to as "FAF for SBH" and that for the cylinder bank SBM will also be referred to as "FAF for SBM"). The FAF deriving routine is executed at every given timing, such as, per 16 msec.

At first step 110, it is determined whether an output of the main air-fuel ratio sensor 21, 22 is on a rich or lean side with respect to a comparison voltage, such as, 0.45 V in this preferred embodiment which represents the stoichiometric air-fuel ratio $\lambda=1$. Accordingly, step 110 determines whether an air-fuel ratio of the air-fuel mixture is rich or lean with respect to a reference air-fuel ratio, such as, the stoichiometric air-fuel ratio $\lambda=1$. If answer is "rich", the routine proceeds to step 120. On the other hand, if answer is "lean", the routine proceeds to step 150.

Step 120 determines whether a last output of the main air-fuel ratio sensor 21, 22 was on the rich or lean side. If answer at step 120 is "rich", that is, if the current and last outputs of the main air-fuel ratio sensor 21, 22 are both "rich", step 130 updates the feedback correction coefficient FAF by an equation $$FAF=FAF-\Delta I,$$

wherein $\Delta I$ represents an integral correction value which is set smaller than a proportional correction value $\Delta P1$. On the other hand, if answer at step 120 is "lean", that is, if the current and last outputs of the main air-fuel ratio sensor 21, 22 are different, step 140 updates the feedback correction coefficient FAF by an equation $$FAF=FAF-\Delta P1.$$

Similarly, step 150 determines whether a last output of the main air-fuel ratio sensor 21, 22 was on the rich or lean side. If answer at step 150 is "lean", that is, if the current and last outputs of the main air-fuel ratio sensor 21, 22 are both "lean", step 170 updates the feedback correction coefficient FAF by an equation $$FAF=FAF+\Delta I.$$

On the other hand, if answer at step 150 is "rich", that is, if the current and last outputs of the main air-fuel ratio sensor 21, 22 are different, step 160 updates the feedback correction coefficient FAF by an equation $$FAF=FAF+\Delta P2,$$

wherein $\Delta P2$ represents a proportional correction value which is set greater than the integral correction value $\Delta I$. The proportional correction values $\Delta P1$ and $\Delta P2$ are updated through a later-described auxiliary feedback control shown in FIGS. 3 and 4, while a sum of these proportional correction values $\Delta P1$ and $\Delta P2$ is set to a fixed value K, that is, $\Delta PI+\Delta P2=K$.

The proportional correction values $\Delta P1$ and $\Delta P2$ are updated for each of the cylinder banks SBH and SBM, while the integral correction value $\Delta I$ is a constant value which is common for both SBH and SBM in this preferred embodiment.

As appreciated from steps 140 and 160, the proportional correction value $\Delta P1$ is exclusively used for reducing FAF, while the proportional correction value $\Delta P2$ is exclusively used for increasing FAF. Accordingly, the proportional correction values $\Delta P1$ and $\Delta P2$ may be defined as lean and rich correction values, respectively.

Based on each of FAF for SBH and FAF for SBM, a fuel injection amount or time TAU is derived for each of the cylinder banks SBH and SBM through a TAU deriving routine of the main feedback control which is executed by the control unit 19 at every given crank angle (hereinafter, the fuel injection time TAU for the cylinder bank SBH will also be referred to as "TAU for SBH" and that for the cylinder bank SBM will also be referred to as "TAU for SBM"). The TAU deriving routine itself is known in the art.

Figure 5:
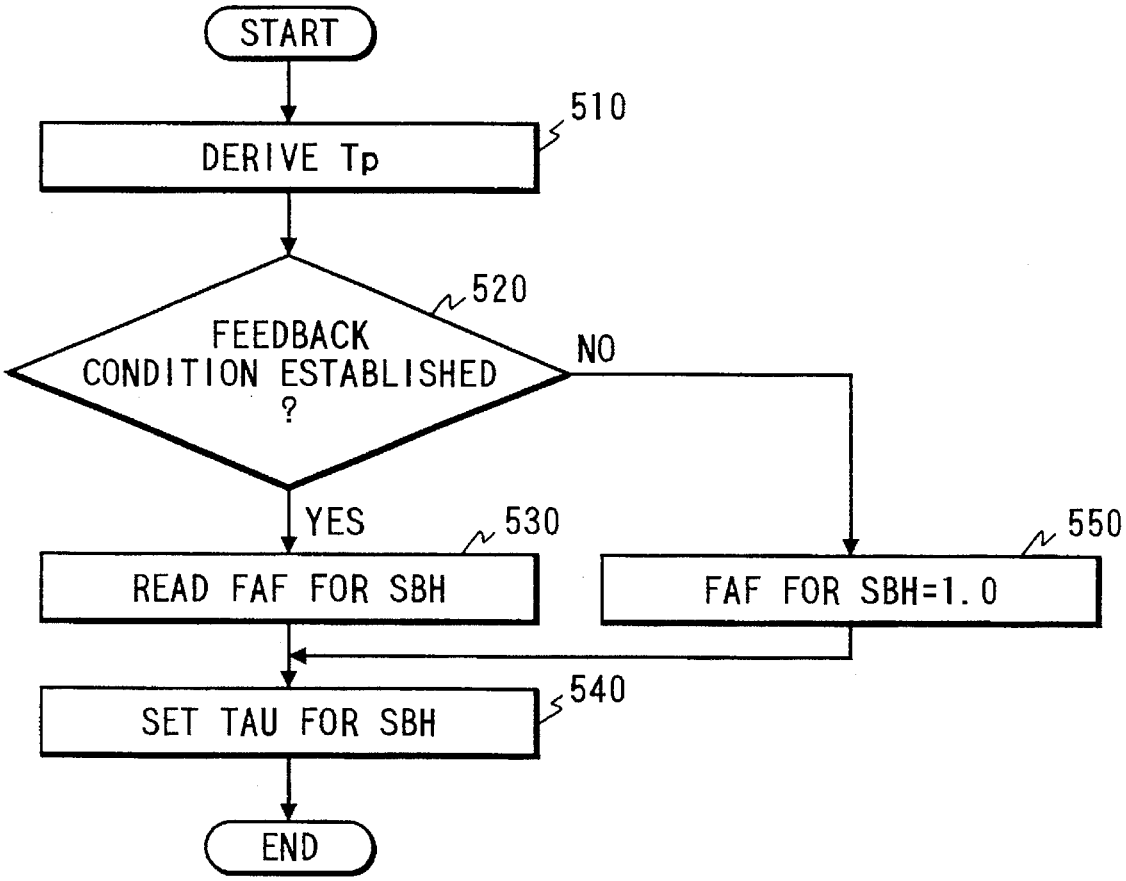
FIG. 5 is a flowchart showing a routine of the main feedback control to be executed by the control unit for deriving a fuel injection amount or time.

For simplification, FIG. 5 shows the TAU deriving routine for deriving TAU for SBH only.

At first step 510, a basic fuel injection time Tp is derived based on am engine speed NE monitored by the rotation angle sensor, an intake air amount Q monitored by the airflow meter 3 and other preselected engine operation parameters. Subsequently, the routine proceeds to step 520 which determines whether a predetermined feedback control condition is established or not. If answer at step 520 is positive, the routine proceeds to step 530 which reads FAF for SBH derived in the FAF deriving routine shown in FIG. 2. On the other hand, if answer at step 520 is negative, the routine proceeds to step 550 where FAF for SBH is set to 1.0.

From step 530 or 550, the routine proceeds to step 540 where TAU for SBH is derived based on an equation as follows:

$$TAU=TAUE+TAUV$$

wherein, TAUV is a value for correcting a mechanical operation delay of the fuel supply system, such as, the fuel injection valve 8 (9) and TAUE is defined by an equation as follows:

$$TAUE=Tp\times FEFI\times FAF$$

wherein, FEFI is a value representative of correction based on an engine operating condition, such as, immediately after engine start-up, during engine warming-up, during acceleration, during deceleration, under high load or the like, and FAF represents FAF for SBH set at step 530 or 550.

As appreciated, TAU for SBM is derived by using FAF for SBM at step 530 or 550 and step 540, instead of FAF for SBH.

Now, the auxiliary feedback control will be described hereinbelow with reference to FIGS. 3 and 4.

The auxiliary feedback control is executed by the control unit 19 at every given timing, such as, per 128 msec. for updating the foregoing proportional correction values ΔP1 and ΔP2 for each of SBH and SBM based on outputs of the auxiliary air-fuel ratio sensors 23 and 24 (hereinafter, the auxiliary air-fuel ratio sensor 23 will also be referred to as "AUX sensor for SBH" and the auxiliary air-fuel ratio sensor 24 will also be referred to as "AUX sensor for SBM"). For simplification, FIG. 3 shows a routine of the auxiliary feedback control for monitoring the output of AUX sensor for SBH only, and FIG. 4 shows a routine of the auxiliary feedback control for updating the proportional correction values ΔP1 and ΔP2 for SBH only.

Figure 3:
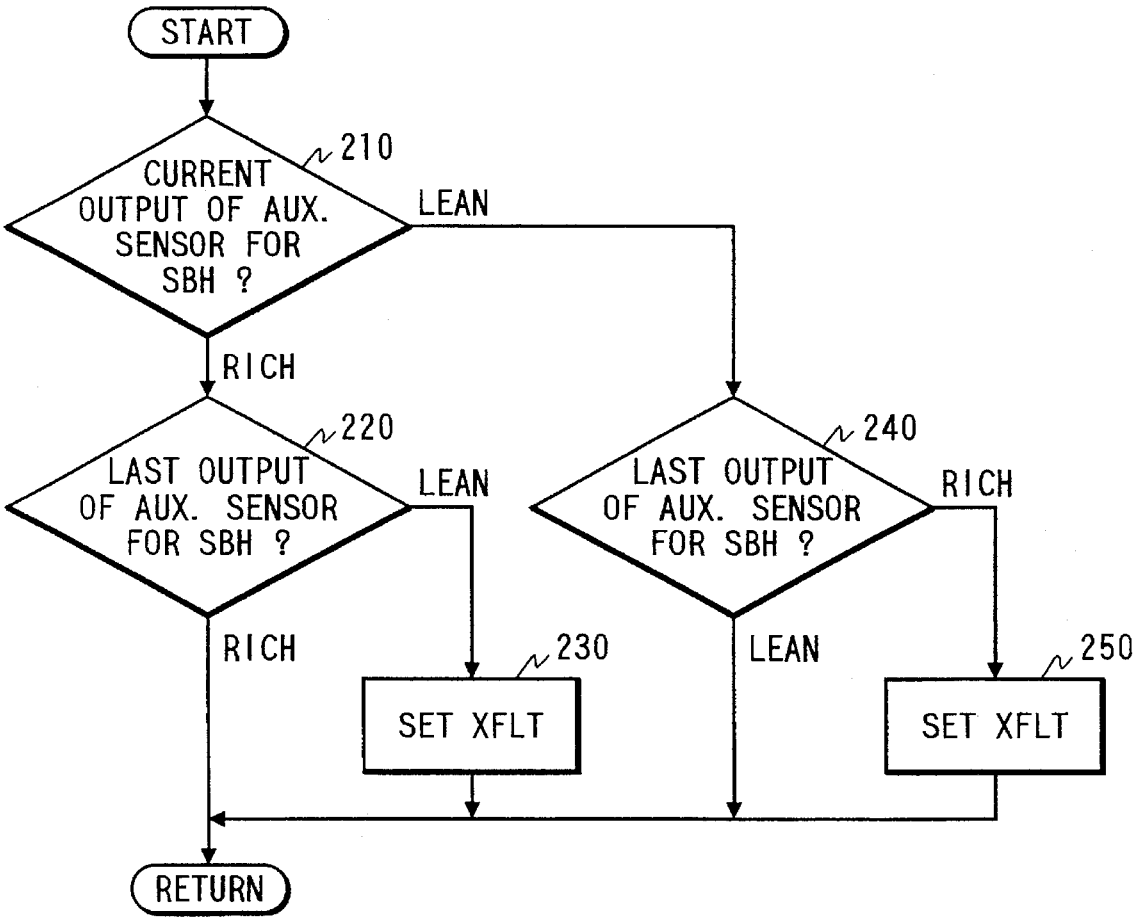
FIG. 3 is a flowchart showing a routine of an auxiliary feedback control to be executed by the control unit for monitoring inversion of an output of an auxiliary air-fuel ratio sensor between rich and lean sides with respect to a given reference voltage.

Specifically, FIG. 3 shows a flowchart of the auxiliary feedback control routine for monitoring inversion of the output of AUX sensor for SBH between the rich and lean sides with respect to a given reference voltage, such as, 0.45 V in this preferred embodiment which represents the stoichiometric air-fuel ratio $\lambda=1$.

At first step 210, it is determined whether a current output of AUX sensor for SBH is on the rich or lean side with respect to the given reference voltage. If answer at step 210 is "rich", the routine proceeds to step 220. On the other hand, if answer at step 210 is "lean", the routine proceeds to step 240. Step 220 determines whether a last output of AUX sensor for SBH, that is, a current output of AUX sensor for SBH in the last execution cycle of this routine, was on the rich or lean side. If answer at step 220 is "rich", that is, the current and last outputs are both "rich", the routine terminates. On the other hand, if answer at step 220 is "lean", that is, the current and last outputs are different, the routine proceeds to step 230 where an inversion flag XFLT is set, and then terminates. Similarly, if the current and last outputs are both "lean" at step 240, the routine terminates, and if the current and last outputs are different at step 240, the routine proceeds to step 250 where the inversion flag XFLT is set, and then terminates.

As appreciated, for monitoring inversion of the output of AUX sensor for SBM, each of steps 210, 220 and 240 reads the output of AUX sensor for SBM, and each of steps 230 and 250 sets an inversion flag XFRT.

Figure 4:
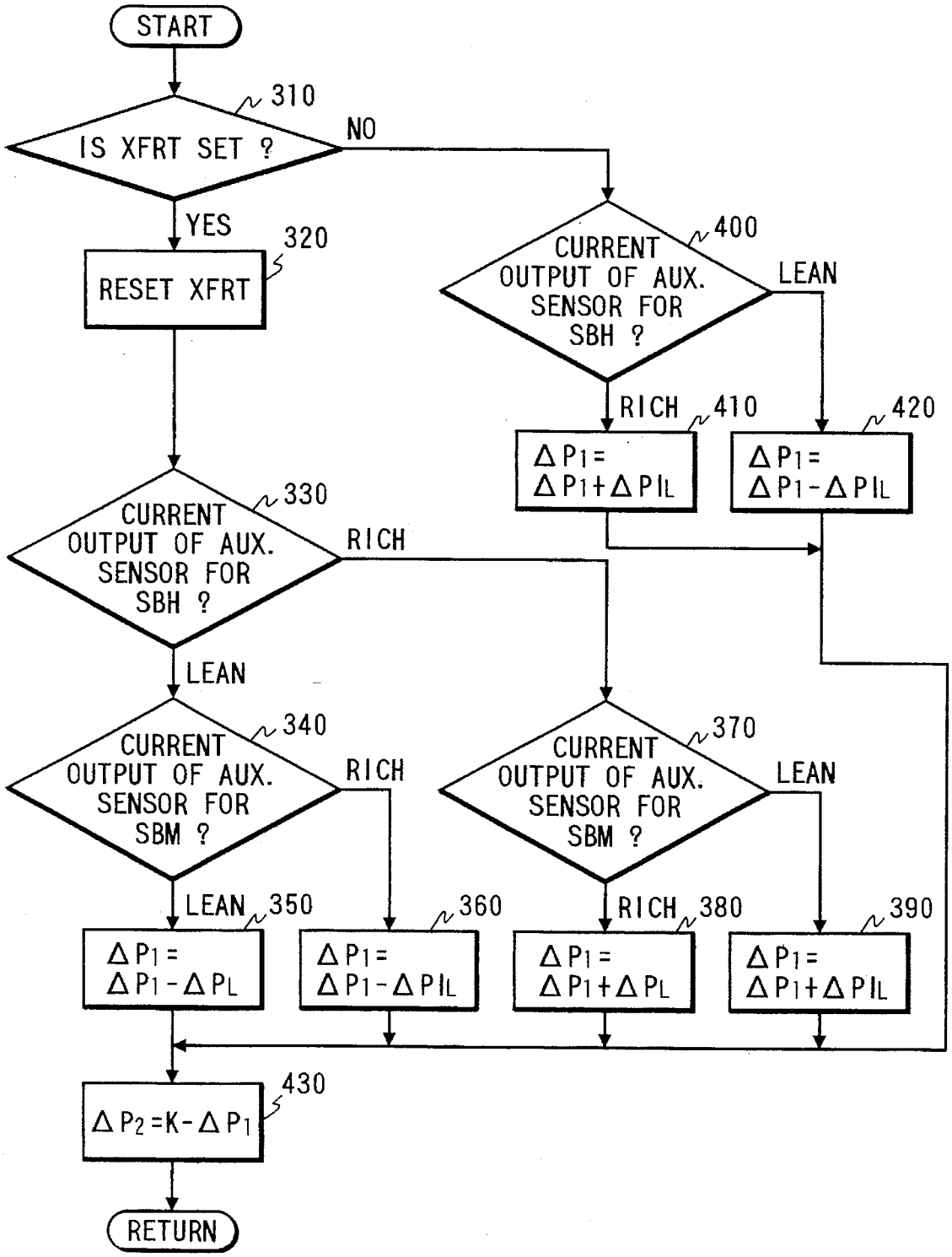
FIG. 4 is a flowchart showing a routine of the auxiliary feedback control to be executed by the control unit for updating proportional correction values for the feedback correction coefficient FAF.

FIG. 4 shows a flowchart of the auxiliary feedback control routine for updating the proportional correction values ΔP1 and ΔP2 for SBH based on the outputs of AUX sensors for SBH and SBM.

At first step 310, it is determined whether the inversion flag XFRT is set or not. If answer at step 310 is positive, step 320 resets the inversion flag XFRT. Subsequently, step 330 determines whether the current output of AUX sensor for SBH is on the rich or lean side. If answer at step 330 is "lean", the routine proceeds to step 340. On the other hand, if answer at step 330 is "rich", the routine proceeds to step 370.

At step 340, it is determined whether the current output of AUX sensor for SBM is on the rich or lean side. If answer at step 340 is "lean", that is, if the current outputs of AUX sensors for SBH and SBM are both "lean", step 350 updates the proportional correction value ΔP1 by an equation $$\Delta P1=\Delta P1-\Delta PL,$$

wherein ΔPL is a proportional correction value which is set greater than an integral correction value ΔPIL. On the other hand, if answer at step 340 is "rich", that is, if the current outputs of AUX sensors for SBH and SBM are different, step 360 updates the proportional correction value ΔP1 by an equation $$\Delta P1=\Delta P1-\Delta PIL.$$

On the other hand, if the current outputs of AUX sensors for SBH and SBM are both "rich" at step 370, step 380 updates the proportional correction value ΔP1 by an equation $$\Delta P1=\Delta P1+\Delta PL.$$

Further, if the current outputs of AUX sensors for SBH and SBM are different at step 370, step 390 updates the proportional correction value ΔP1 by an equation $$\Delta P1=\Delta P1+\Delta PIL.$$

Referring back to step 310, if answer at step 310 is negative, that is, the inversion flag XFRT is reset, the routine proceeds to step 400 which determines whether the current output of AUX sensor for SBH is on the rich or lean side like step 330. If answer at step 400 is "rich", step 410 updates the proportional correction value ΔP1 by an equation $$\Delta P1=\Delta P1+\Delta PIL.$$

On the other hand, if answer at step 400 is "lean", step 420 updates the proportional correction value ΔP1 by an equation $$\Delta P1=\Delta P1-\Delta PIL.$$

From step 350, 360, 380, 390, 410 or 420, the routine proceeds to step 430 which updates the proportional correction value ΔP2 by an equation $$\Delta P2=K-\Delta P1,$$

wherein K is the fixed value as described before. This routine then terminates.

As appreciated, for updating the proportional correction values ΔP1 and ΔP2 for SBM, step 310 determines whether the inversion flag XFLT is set or not, step 320 resets the inversion flag XFLT, each of steps 330 and 400 reads the current output of AUX sensor for SBM, and each of steps 340 and 370 reads the current output of AUX sensor for SBH. Further, ΔPL at each of steps 350 and 380 is replaced by ΔPR, and ΔPIL at each of steps 360, 390, 410 and 420 is replaced by ΔPIR. ΔPL and ΔPR may be set to the same value or different values, and ΔPIL and ΔPIR may be set to the same value or different values.

As described before, the air-fuel ratio control system according to this preferred embodiment aims to improve the purification of the exhaust gas by finely adjusting the air-fuel ratio of the air-fuel mixture such that the exhaust gases downstream of the catalytic converters 15 and 16 for SBH and SBM are monitored to prohibit the components of the exhaust gases from SBH and SBM from being substantially the same with each other. For this purpose, the outputs of the auxiliary air-fuel ratio sensors 23 and 24 (AUX sensors for SBH and SBM) provided downstream of the catalytic converters 15 and 16 are monitored. When the outputs of AUX sensors for SBH and SBM are in antiphase with each other, the auxiliary feedback control is performed on a moderate basis as shown at step 360, 390, 410 or 420 in FIG. 4, using the integral correction values ΔPIL and ΔPIR each set to a relatively small value.

As appreciated from step 360 or 390 in FIG. 4, even when the output of one of AUX sensors for SBH and SBM is inverted between "rich" and "lean", the auxiliary feedback control for the other cylinder bank is also performed on the moderate basis as long as the current outputs of AUX sensors for SBH and SBM are in antiphase with each other, that is, one is "rich" and the other is "lean". This is clearly seen from FIG. 6 which is a time chart showing time-domain operations of the overall feedback control, that is, the foregoing main and auxiliary feedback controls. For example, at a time point t1, the output of AUX sensor for SBH is inverted from "rich" to "lean". However, since the outputs of AUX sensors for SBH and SBM are in antiphase with each other until a time point t2, the moderate auxiliary feedback control is performed so that FAF for SBM is reduced by ΔP1+ΔPIR, that is, the proportional correction value ΔP1 was updated by the equation $$\Delta P1=\Delta P1+\Delta PIR.$$

Figure 6:
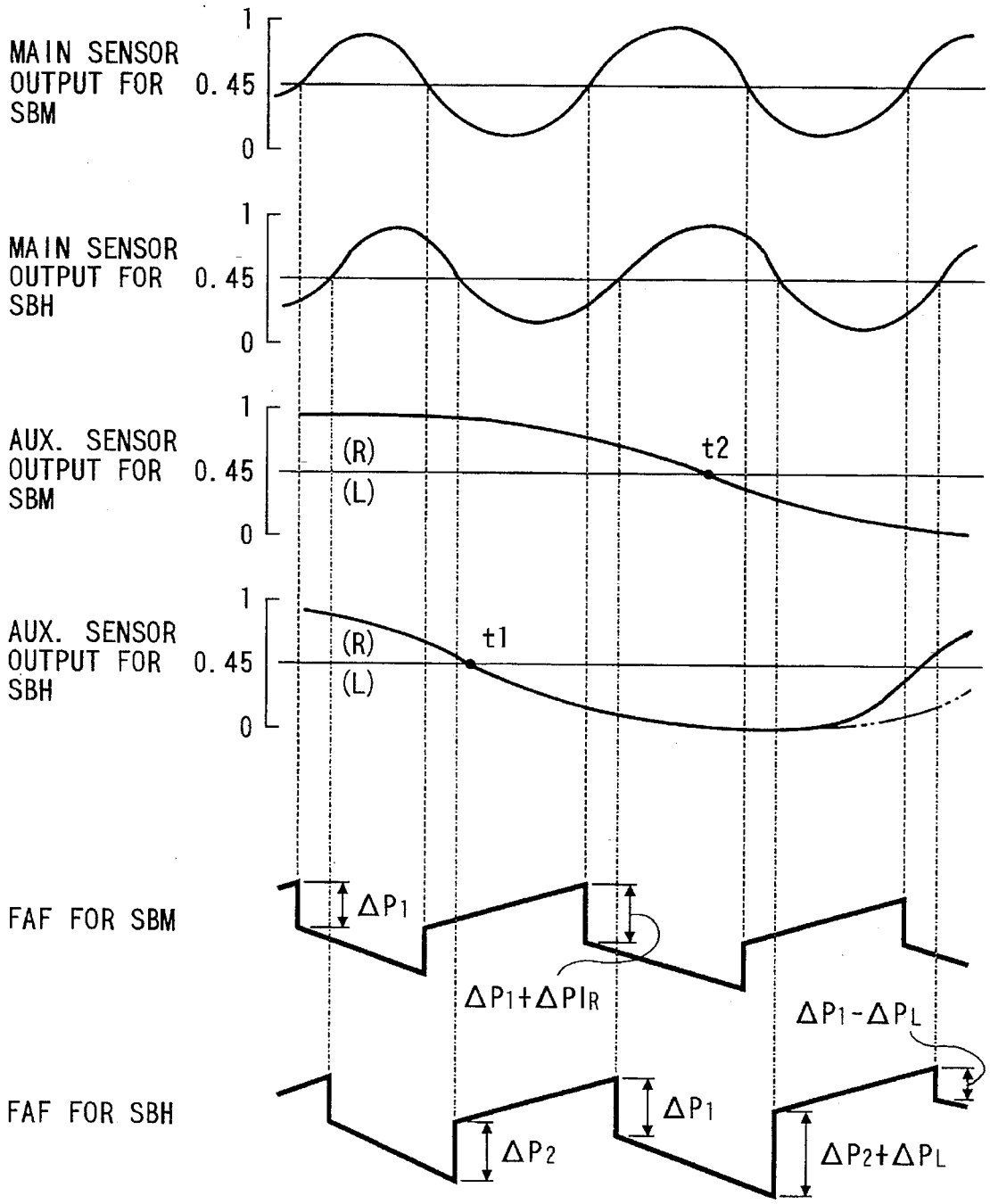
FIG. 6 is a time chart for explaining operations of the overall feedback control according to the preferred embodiment of the present invention.

On the other hand, when the current outputs of AUX sensors for SBH and SBM are in phase with each other after inversion of the output of one of AUX sensors for SBH and SBM, FAF for the other cylinder bank is changed largely so as to control the outputs of AUX sensors for SBH and SBM to be in antiphase with each other. For example, at a time point t2 in FIG. 6, the output of AUX sensor for SBM is inverted from "rich" to "lean". Further, the outputs of AUX sensors for SBH and SBM after the time point t2 are both "lean". Accordingly, step 350 in FIG. 4 is executed to update the proportional correction value ΔP1 by ΔP1=ΔP1−ΔPL, that is, ΔP2=ΔP2+ΔPL. As a result, FAF is largely increased by ΔP2+ΔPL. As a result, as shown in FIG. 6, the output of AUX sensor for SBH is quickly inverted to the rich side as represented by a solid line as compared with a two-dot chain line which shows the change of the output of AUX sensor for SBH without such a large increment of FAF for SBH. As appreciated from the solid line in FIG. 6, the outputs of AUX sensors for SBH and SBM are quickly controlled to be in antiphase with each other.

In the foregoing preferred embodiment, when the output of one of AUX sensors for SBH and SBM is inverted between "rich" and "lean", the proportional correction value ΔP1 for this inverted cylinder bank is not changed largely unless the condition is matched as seen from FIG. 4. This is because it is likely that the exhaust gas upstream of the catalytic converter 15, 16 immediately after inversion of the output of the corresponding AUX sensor is largely deviated from λ=1 due to a large response delay of the catalytic converter 15, 16.

Further, in the auxiliary feedback control according to the foregoing preferred embodiment, the proportional correction values ΔP1 and ΔP2 have such a relationship that, as one of them increases, the other of them decreases, and vice versa, that is, they change in opposite directions from each other. On the other hand, the auxiliary feedback control may be performed by changing the integral correction value ΔI, the comparison voltage for the air-fuel ratio sensors 21 and 22 or the like.

Figure 7:
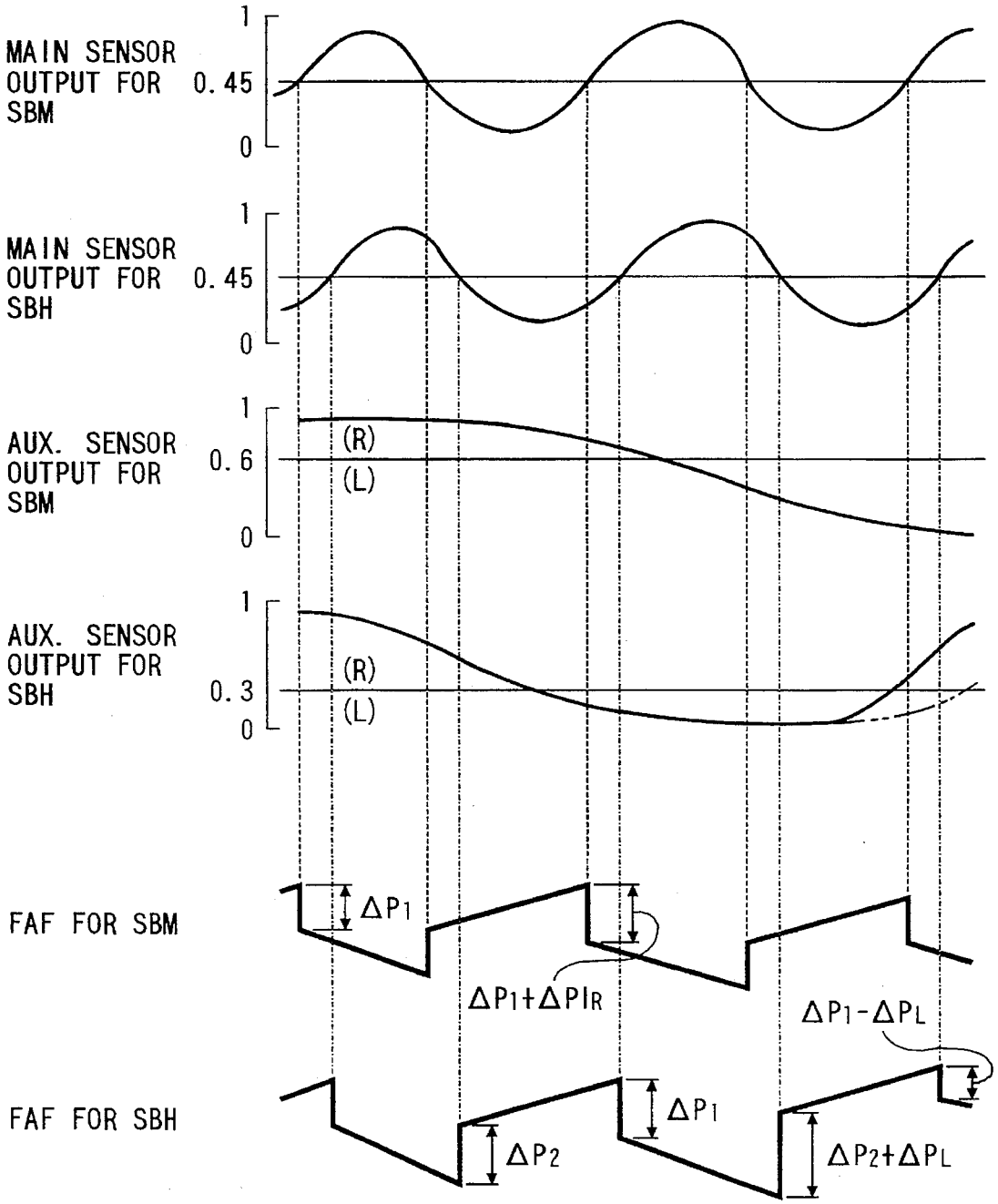
FIG. 7 is a time chart for explaining operations of the overall feedback control according to a modification of the preferred embodiment.

Further, comparison voltages of AUX sensors for SBH and SBM may be set to different values so as to ensure the antiphase control of the outputs thereof. Specifically, as shown in FIG. 7, a comparison voltage of AUX sensor for SBM may be set to a high value, such as, 0.6 V, while that of AUX sensor for SBH may be set to a low value, such as, 0.3 V. In this arrangement, the exhaust gas components from SBM are controlled to a richer side, while those from SBH are controlled to a leaner side.

Further, in the auxiliary, feedback control, the integral action (one of the integral correction values ΔPIL and ΔPIR) may be set faster from "lean" to "rich", while the integral action (the other of the integral correction values ΔPIL and ΔPIR) may be set faster from "rich" to "lean". This arrangement is also effective for controlling the outputs of AUX sensors for SBH and SBM to be in antiphase with each other.

According to the foregoing preferred embodiment and modifications thereof, the exhaust gases from the respective cylinder banks SBH and SBM are controlled to be in antiphase with each other in terms of air-fuel ratio at the catalytic converter 17 provided in the common exhaust pipe 13. Accordingly, the purification of the exhaust gas is effectively achieved at the catalytic converter 17 with a sufficient supply of the mutually reactive components contained in the antiphase exhaust gases.

It is to be understood that this invention is not to be limited to the preferred embodiments and modifications described above, and that various changes and modifications may be made without departing from the spirit and scope of the invention as defined in the appended claims.

What is claimed is:

1. An air-fuel ratio control system for an internal combustion engine, comprising:

a pair of cylinder banks;

a pair of exhaust passages connected to said cylinder banks, respectively;

a common exhaust pipe where said exhaust passages join each other at their downstream ends;

a pair of catalytic converters provided in said exhaust passages, respectively;

a pair of main air-fuel ratio sensors provided in said exhaust passages upstream of said catalytic converters, respectively;

a pair of auxiliary air-fuel ratio sensors provided in said exhaust passages downstream of said catalytic converters, respectively;

a catalytic converter provided in said common exhaust pipe;

deriving means for deriving an air-fuel ratio feedback control correction value for each of said cylinder banks based on outputs of said auxiliary air-fuel ratio sensors, said deriving means deriving said air-fuel ratio feedback control correction values so as to control said outputs of said auxiliary air-fuel ratio sensors to be in antiphase with each other when said outputs of said auxiliary air-fuel ratio sensors are in phase with each other; and feedback control means for feedback controlling an air-fuel ratio of an air-fuel mixture for each of said cylinder banks based on an output of said main air-fuel ratio sensor for said cylinder bank and said air-fuel ratio feedback control correction value for said cylinder bank.

2. The air-fuel ratio control system as set forth in claim 1, wherein said deriving means largely changes said air-fuel ratio feedback control correction value for at least one of said cylinder banks so as to control the output of said auxiliary air-fuel ratio sensor for said at least one of said cylinder banks to be in antiphase with the output of said auxiliary air-fuel ratio sensor for the other of said cylinder banks when the outputs of said auxiliary air-fuel ratio sensors are in phase with each other.

3. The air-fuel ratio control system as set forth in claim 1, wherein said deriving means includes means for determining whether the outputs of said auxiliary air-fuel ratio sensors are in phase with each other when at least one of the outputs of said auxiliary air-fuel ratio sensor is inverted between rich and lean sides with respect to a given reference value.

4. The air-fuel ratio control system as set forth in claim 3, wherein, when the outputs of said auxiliary air-fuel ratio sensors are in phase with each other, said deriving means changes with a first correction value said air-fuel ratio feedback control correction value for the cylinder bank where the output of said auxiliary air-fuel ratio sensor is non-inverted, while said deriving means changes with a second correction value said air-fuel ratio feedback control correction value for the cylinder bank where the output of said auxiliary air-fuel ratio sensor is inverted, said first correction value being set greater than said second correction value.

5. The air-fuel ratio control system as set forth in claim 1, wherein said deriving means includes determining means for determining whether the air-fuel ratios as monitored in said exhaust passages downstream of said catalytic converters are rich or lean by comparing the outputs of said auxiliary air-fuel ratio sensors with corresponding given reference values, respectively, and wherein said determining means sets one of said reference values to be greater than a value corresponding to a stoichiometric air-fuel ratio and the other of said reference values to be smaller than said value corresponding to the stoichiometric air-fuel ratio.

6. An air-fuel ratio control system for am internal combustion engine, comprising:

a pair of cylinder banks;

a pair of exhaust passages connected to said cylinder banks, respectively;

a common exhaust pipe where said exhaust passages join each other at their downstream ends;

a pair of catalytic converters provided in said exhaust passages, respectively;

a pair of main air-fuel ratio sensors provided in said exhaust passages upstream of said catalytic converters, respectively;

a pair of auxiliary air-fuel ratio sensors provided in said exhaust passages downstream of said catalytic converters, respectively;

a catalytic converter provided in said common exhaust pipe;

deriving means for deriving first and second air-fuel ratio feedback control correction values for each of said cylinder banks based on outputs of said auxiliary air-fuel ratio sensors, said deriving means deriving said first and second air-fuel ratio feedback control correction values so as to control said outputs of said auxiliary air-fuel ratio sensors to be in antiphase with each other when the outputs of said auxiliary air-fuel ratio sensors are in phase with each other, said first air-fuel ratio control correction value for each of said cylinder banks to be used for controlling an air-fuel ratio of an air-fuel mixture for the corresponding cylinder bank to be leaner while said second air-fuel ratio control correction value for each of said cylinder banks is used for controlling the air-fuel ratio to be richer; and feedback control means for feedback controlling the air-fuel ratio of the air-fuel mixture for each of said cylinder banks based on an output of said main air-fuel ratio sensor for said cylinder bank and one of said first and second air-fuel ratio feedback control correction values for said cylinder bank.

7. The air-fuel ratio control system as set forth in claim 6, wherein said deriving means increases said first air-fuel ratio feedback control correction value when the output of the corresponding auxiliary air-fuel ratio sensor is on a rich side with respect to a given reference value, and wherein said deriving means increases said second air-fuel ratio feedback control correction value when the output of the corresponding auxiliary air-fuel ratio sensor is on a lean side with respect to the given reference value.

8. The air-fuel ratio control system as set forth in claim 7, wherein said first and second air-fuel ratio feedback control correction values have such a relationship that said first and second air-fuel ratio feedback control correction values change in opposite directions from each other.

9. The air-fuel ratio control system as set forth in claim 8, wherein a sum of said first and second air-fuel ratio feedback control correction values is a fixed value.

10. The air-fuel ratio control system as set forth in claim 9, wherein said deriving means largely increases said first air-fuel ratio feedback control correction value for at least one of said cylinder banks so as to control the output of said auxiliary air-fuel ratio sensor for said at least one of said cylinder banks to be in antiphase with the output of said auxiliary air-fuel ratio sensor for the other of said cylinder banks when the outputs of said auxiliary air-fuel ratio sensors are in phase with each other and on the rich side, and wherein said deriving means largely decreases said first air-fuel ratio feedback control correction value for at, least one of said cylinder banks so as to control the output of said auxiliary air-fuel ratio sensor for said at least one of said cylinder banks to be in antiphase with the output of said auxiliary air-fuel ratio sensor for the other of said cylinder banks when the outputs of said auxiliary air-fuel ratio sensors are in phase with each other and on the lean side.

* * * * *